US011232771B2

(12) United States Patent
Dunwoodie

(10) Patent No.: US 11,232,771 B2
(45) Date of Patent: Jan. 25, 2022

(54) PLECTRUM HAVING A REGULAR GRIP AND A THICKER STRING CONTACT PORTION

(71) Applicant: David Dunwoodie, Delta (CA)

(72) Inventor: David Dunwoodie, Delta (CA)

( * ) Notice: Subject to any disclaimer, the term of this patent is extended or adjusted under 35 U.S.C. 154(b) by 0 days.

(21) Appl. No.: 16/963,693

(22) PCT Filed: Jan. 25, 2019

(86) PCT No.: PCT/CA2019/050094
§ 371 (c)(1),
(2) Date: Jul. 21, 2020

(87) PCT Pub. No.: WO2019/144236
PCT Pub. Date: Aug. 1, 2019

(65) Prior Publication Data

US 2021/0082376 A1 Mar. 18, 2021

Related U.S. Application Data

(60) Provisional application No. 62/622,496, filed on Jan. 26, 2018.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS

| | | | | | |
|---|---|---|---|---|---|
| 2,481,759 | A * | 9/1949 | Lawrence | G10D 3/173 | 84/322 |
| 4,691,609 | A * | 9/1987 | Acocella | G10D 3/173 | 84/322 |
| 4,711,150 | A * | 12/1987 | Hyduck | G10D 3/173 | 84/322 |
| 5,610,349 | A * | 3/1997 | Fogarty | G10D 3/173 | 84/322 |
| 5,648,622 | A * | 7/1997 | Storey | G10D 3/173 | 84/322 |
| 5,859,377 | A * | 1/1999 | Mackey | G10D 3/173 | 84/322 |
| 6,130,374 | A * | 10/2000 | Polidori | G10D 3/173 | 84/322 |
| 7,067,729 | B2 * | 6/2006 | Leong | G10D 3/173 | 84/322 |

(Continued)

FOREIGN PATENT DOCUMENTS

JP 3137448 10/2007

*Primary Examiner* — Robert W Horn

(57) ABSTRACT

A plectrum for striking a stringed instrument is planar so as to define a first side and a second side opposite the first side. The plectrum has a wide end a narrow end opposite the wide end. The plectrum includes: (a) a gripping portion disposed at the wide end, the gripping portion having a first thickness and a first flex; and (b) a thicker portion disposed at the narrow end, the thicker portion having a second thickness that is at least 10% greater than the first thickness and having a second flex that is less than the first flex, the plectrum defining a tip having a thickness greater than the first thickness.

16 Claims, 1 Drawing Sheet

(56) References Cited

U.S. PATENT DOCUMENTS

| | | | | |
|---|---|---|---|---|
| 7,238,869 | B1 * | 7/2007 | Kleckzka | G10D 3/173 84/322 |
| 7,265,285 | B2 * | 9/2007 | Storey | B29C 45/14336 84/322 |
| 8,019,130 | B2 * | 9/2011 | Aletto | G10D 3/173 382/124 |
| 8,035,017 | B1 * | 10/2011 | Morris | G10D 3/173 84/320 |
| 8,648,239 | B2 * | 2/2014 | Tommasi | G10D 3/173 84/322 |
| 9,202,446 | B2 * | 12/2015 | Gauthier | G10D 3/173 |
| 9,418,632 | B2 * | 8/2016 | Snyder | G10D 3/173 |
| 9,576,561 | B2 * | 2/2017 | Thompson | G10D 3/173 |
| 9,691,365 | B2 * | 6/2017 | Pascale | G10D 3/173 |
| 9,947,300 | B2 * | 4/2018 | Altavilla | G10D 3/173 |
| 10,418,004 | B1 * | 9/2019 | Tomasi | G10D 3/173 |
| 2007/0079685 | A1 * | 4/2007 | Mizek | G10D 3/173 84/322 |
| 2008/0163737 | A1 * | 7/2008 | Grant | G10D 3/173 84/320 |
| 2015/0206516 | A1 | 7/2015 | Thompson | |
| 2021/0082376 | A1 * | 3/2021 | Dunwoodie | G10D 3/173 |

* cited by examiner

PLECTRUM HAVING A REGULAR GRIP AND A THICKER STRING CONTACT PORTION

BACKGROUND OF THE INVENTION

1. Field of Invention

This invention relates to musical accessories and, in particular, to a plectrum having a regular grip but a thicker portion useful for striking, strumming or plucking strings of a musical instrument.

2. Description of Related Art

Plectrums, commonly referred to as picks, are used for striking the strings of a stringed musical instrument when gripped by a musician's hand. The thickness of a plectrum affects the ease of gripping the plectrum, the ease of playing and the sound produced by the musical instrument.

Conventional plectrums have the same thickness where gripped as where used for striking, thus many musicians are habituated to a standard thickness of grip. However, this results in inconvenience of gripping if, for musical reasons, the thickness of the plectrum where striking the strings is desired to be thick.

U.S. Pat. No. 7,067,729 to Leong discloses a plectrum having one thickness at a plurality of edges of two portions offset transversely by a stepped member. However, the single edge thickness of the plectrum of Leong restricts the plectrum to a trade-off between thickness where striking the strings and where gripped.

U.S. Pat. No. 6,245,977 to Byrns discloses a plectrum having a panel whose thickness decreases to relatively thin inner and outer points where striking occurs. Accordingly, the plectrum of Byrns is not suitable if the thickness of the plectrum where striking the strings is desired to be thick.

An object of the invention is to address the above shortcomings.

SUMMARY

The above shortcomings may be addressed by providing, in accordance with one aspect of the invention, a plectrum for striking a stringed instrument, the plectrum being planar so as to define a first side and a second side opposite the first side, the plectrum comprising: (a) a gripping portion disposed at a wide end of the plectrum, the gripping portion having a first thickness; and (b) a thicker portion disposed at a narrow end of the plectrum opposite the wide end, the thicker portion having a second thickness that is at all points of the thicker portion at least 10% greater than the first thickness, the plectrum defining a tip in some embodiments.

The first thickness may be in the range of 0.4 mm to 2.0 mm. The first thickness may be 0.9 mm. The gripping portion has a definite amount of flex depending on the thickness of the first thickness, akin to a conventional pick or plectrum. The flex of the gripping portion is thus dependent on the material and the thickness thereof, but the flex is not variable. The second thickness may be at least 10% greater than the first thickness. The second thickness may be in the range of 2.0 mm to 10.0 mm. The second thickness may be 3.0 mm. The thicker portion may be dimensioned to facilitate striking or strumming the strings of the stringed instrument. The flex of the thicker portion is less than the flex of the gripping portion, and in embodiments where the thickness of the thicker portion is significantly greater than the thickness of the gripping portion, the thicker portion may be inflexible.

The plectrum may include a beveled edge. The beveled edge may provide a transition in thickness from the second thickness to the first thickness. The plectrum may include a beveled edge at each of the first and second sides. Each beveled edge may include a plurality of edge sections. The plurality of edge sections may include a transition edge section, a left edge section and a right edge section. The plectrum may define a central plane between the first and second sides. The plectrum may be symmetrical about the central plane. The plectrum may define a plectrum area equal to the total surface area parallel to the central layer on one of the first and second sides. The gripping portion may define a gripping portion area parallel to the central layer. The gripping portion area may be in the range of 50% to 80% of the plectrum area. The thicker portion may define a thicker portion area parallel to the central layer. The thicker portion area may be in the range of 10% to 40% of the plectrum area. Each beveled edge may define a beveled area parallel to the central layer. The beveled area may be in the range of 10% to 30% of the plectrum area. The plectrum may be made of a polymer. The plectrum may be made of a plastic. The plectrum may be made of acrylic. The plectrum may be made of nylon. The plectrum may be made of wood. The plectrum may be made of a stone. The plectrum may be made of a bone or other natural materials. The plectrum may be made of any combination of these materials. The gripping portion and the plucking portion may be integrally attached to each other.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

A plectrum includes: (a) gripping means for facilitating gripping the plectrum; and (b) plucking means for striking a stringed instrument. The plectrum may further include transition means for transitioning between the gripping means and the plucking means. The plucking means may include tip means for contacting a string of the stringed instrument.

Figure 1:
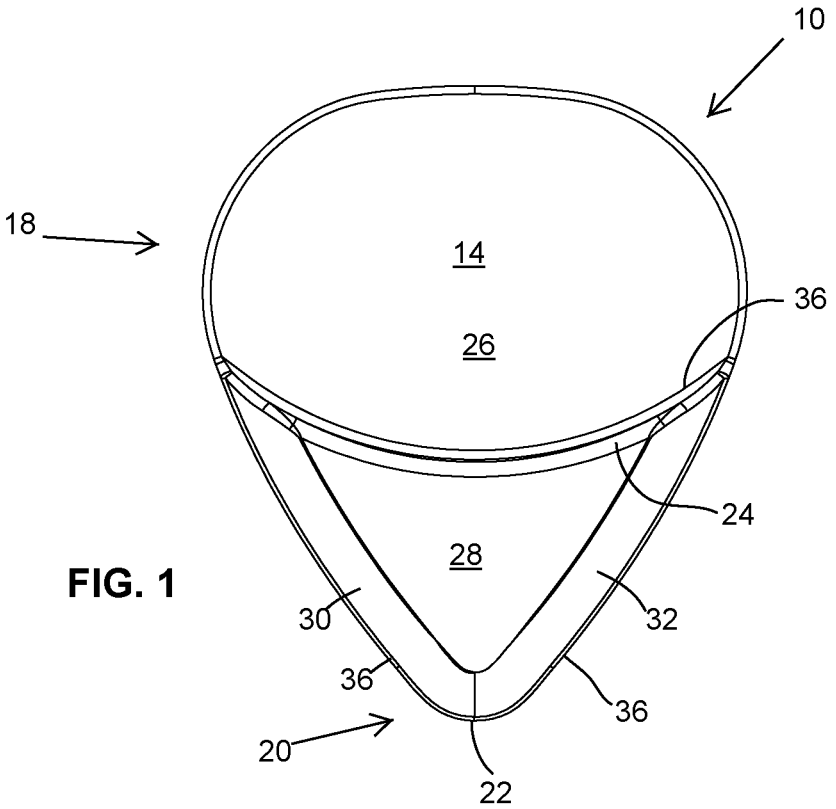
FIG. 1 is a front view of a plectrum according to a first embodiment of the invention, showing a gripping portion and a thicker portion.
Figure 2:
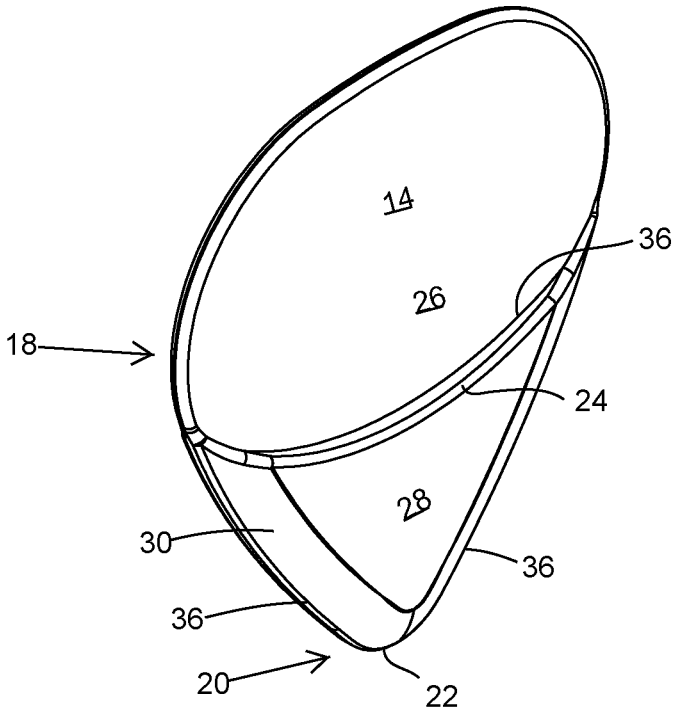
FIG. 2 is a perspective view of the plectrum shown in FIG. 1, showing a gripping portion and a thicker portion.
Figure 3:
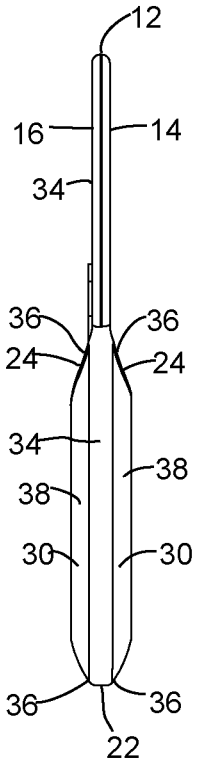
FIG. 3 is a side view of the plectrum shown in FIG. 1, showing the gripping portion having a first thickness and the thicker portion having a second thickness.

Referring to FIGS. 1-3, the plectrum according to a first and preferred embodiment of the invention is shown generally at 10. The plectrum 10 is operable for use in striking strings of an instrument (not shown), such as a guitar, banjo, bass, lute, zither, ukulele or other musical instrument. The plectrum 10 is useful as a guitar pick, for example.

The plectrum 10 is generally planar so as to define a central plane 12. A first side 14 and a second side 16 project from opposing sides of the central plane 12. The first and second sides 14 and 16 together define a thickness at each cross-sectional point of the planar plectrum 10. Preferably, the plectrum 10 is symmetrical about the central plane 12, although non-symmetrical variations are within the scope of the present invention.

The plectrum 10 generally has a triangular shape, such as a teardrop shape, and defines a wide end 18, and a narrow end 20 opposite the wide end 18. A tip 22 may be defined at the intersection of the plectrum 10 and a plane perpendicular to the central plane 12 that is tangential to the narrowest extremity of the narrow end 20. While the Figures show the plectrum 10 as having a teardrop shape, other shapes are possible and within the scope of the present invention.

Between the wide end 18 and the narrow end 20, the thickness of the plectrum 10 transitions along a generally arcuate path forming the transition bevel 24.

A gripping portion 26 extends about the area between the transition bevel 24 and the wide end 18 of the plectrum 10. The gripping portion 26 is dimensioned for ease of gripping by a musician. For example, the plectrum 10 at the gripping portion 26 may be gripped between the thumb and forefinger (not shown). The thickness of the gripping portion 26 is preferably selected to facilitate ease of gripping, including having a standard thickness habituated to by a number of musicians, and may be in the range of 0.4 mm (0.0157 inches) to 2.0 mm (0.0787 inches), for example. By way of further example, the thickness of the plectrum 10 shown in FIG. 2 at its gripping portion 26 is approximately 0.9 mm (0.0354 inches). The gripping portion has a definite amount of flex depending on the thickness of the first thickness, akin to a conventional pick or plectrum. The flex of the gripping portion is thus dependent on the material and the thickness thereof, but the flex of the gripping portion is not variable.

A thicker portion 28 extends about the area from the transition bevel 24 to the narrow end 20, excluding the transition bevel 24, a left bevel 30, a right bevel 32 and the tip 22. The thicker portion 28 is dimensioned to facilitate in plucking or strumming the strings of a stringed instrument. The strings of a stringed instrument may be plucked using the thicker portion 28.

In the first embodiment, the thickness of the plectrum 10 at its thicker portion 28 is greater than the thickness of the plectrum 10 at its gripping portion 26. For example, the plectrum 10 at its thicker portion 28 may have a thickness in the range 2.0 mm (0.0787 inches) to 10.0 mm (0.394 inches). As shown in FIGS. 1 and 2, the plucking portion 28 has a thickness of 3.0 mm (0.118 inches). In the first embodiment, the plectrum 10 has a substantially constant thickness at its thicker portion 28, although a variable thickness is within the scope contemplated by the present invention. In variations of embodiments, the thickness of the thicker portion 28 may be as little as 10% greater than the thickness of the gripping portion 26 or as much as many times the thickness of the gripping portion 26. The flex of the thicker portion 28 is less than the flex of the gripping portion 26, and in embodiments where the thickness of the thicker portion 28 is significantly greater than the thickness of the gripping portion 26, the thicker portion may be inflexible.

FIG. 2 shows the thicker portion 28 having a thickness that is approximately 300% (or three times) greater than the thickness of the gripping portion 26. Such extra thickness advantageously provides a stiffer plectrum 10 at its thicker portion 28, thereby providing a musically "fast" feel to plucking or strumming, while providing a gripping portion 26 that is advantageously of a desired thickness for desired flexibility and ease of grip. The thickness of the plectrum 10 at its gripping portion 26 may be a standard thickness, for example.

In the first embodiment, around the thicker portion 28 on both the first and second sides 14 and 16 of the plectrum 10 the plectrum 10 is beveled along the transition bevel 24, along the left bevel 30, and along the right bevel 32. As best seen in FIG. 2, the thickness of the plectrum 10 at its bevels 24, 30 and 32 transitions from the larger thickness of the thicker portion 28 to that of the relatively thinner central layer 34 that includes the gripping portion 26. In the first embodiment, the thickness of the central layer 34 is equal to the thickness of the gripping portion 26. Also in the first embodiment, the thickness of the plectrum 10 at its tip 22 is equal to the thickness of the central layer 34. However, in variations the thickness of the plectrum 10 at its tip 22 is greater than the thickness of the central layer 34, such as by the bevels 30 and 32, or portion(s) thereof, not extending as far as shown as FIGS. 1 and 2.

The bevels 24, 30 and 32 define an adjacent outer bevel edge 36 having a thickness equal to that of the central layer 34 because the bevel edge 36 is at and forms part of the central layer 34. The thicker portion 28 excludes the bevels 24, 30 and 32 and the bevel edge 36. Accordingly, the thickness of the plectrum 10 at each point in the area defined by the thicker portion 28 is greater than the thickness of the plectrum 10 at the gripping portion 26, and preferably at least 10% greater. Thus, the plectrum 10 maintains its advantageous stiffer thicker portion 28, used to strum or pluck the strings, while also maintaining its advantageous gripping portion 26 having a desired thickness for desired flexibility and ease of grip.

In a range of variations of some embodiments, the area defined by the gripping portion 26 is in the range of 50% to 80% of the total plectrum 10 area parallel to the central layer 34. The area defined by the thicker portion 28 is in the range of 10% to 40% of the total plectrum 10 area. The area defined by the bevels 24, 30 and 32 is in the range of 10% to 30% of the total plectrum 10 area.

Thus, there is provided a plectrum for striking a stringed instrument, the plectrum comprising: (a) a gripping portion having a first thickness and a first flex; and (b) a thicker portion having a second thickness greater than the first thickness and a second flex that is less than the first flex.

Method of Manufacturing

The plectrum 10 may be made of any suitable material, such as plastic, rubber, wood, metal, glass, stone, or any combination thereof for example. When made by a plastic such as acrylic, nylon, thermoplastic, celluloid or other plastic material, the plectrum 10 may be made of a single material or a plurality of different materials. The plectrum 10 may be manufactured as a single piece of uniform material, or may be made of multiple layers fused or otherwise attached to each other. Whether made of a single or multiple materials, the plectrum 10 may be manufactured by molding, such as injection molding, or other manufacturing techniques.

Referring to FIGS. 1 and 2, in a first manufacturing technique the plectrum 10 is made as a single layer encompassing and integrating all parts of the plectrum 10.

Alternatively, the central layer 34 is made first, followed by the additional layers 38 on opposing sides of the plectrum 10 that give the extra thickness to the thicker portion 28. The central layer 34 and the additional layers 38 may be made of the same or different materials, for example. After the plectrum 10 is formed, the gripping portion 26 and the thicker portion 28 are integrally attached to each other.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A plectrum for striking a stringed instrument, the plectrum comprising:

(a) a gripping portion having a uniform first thickness and a first flex;

(b) a thicker portion that is narrower than the gripping portion having a second thickness greater than the first thickness and a second flex that is less than the first flex; and (c) an arcuate transition bevel that is concave relative to the gripping portion and extending between the uniform gripping portion and the thicker portion.

2. The plectrum of claim 1 wherein the plectrum is symmetrical about a central plane of the plectrum.

3. The plectrum of claim 1 wherein the second thickness is at least 10% greater than the first thickness.

4. The plectrum of claim 3 wherein the first thickness is in the range of 0.4 mm to 2.0 mm and the second thickness is in the range of 2.0 mm to 10.0 mm.

5. The plectrum of claim 3 wherein the second thickness is at least three times greater than the first thickness.

6. The plectrum of claim 5 wherein the first thickness is 0.9 mm and the second thickness is 3.0 mm.

7. The plectrum of claim 1 wherein the thicker portion is inflexible.

8. The plectrum of claim 1 wherein the thicker portion defines a tip dimensioned for contacting a string of the stringed instrument.

9. The plectrum of claim 1 wherein the plectrum defines a plectrum area on each side thereof, the gripping portion having a gripping portion area in the range of 50% to 80% of the plectrum area, the thicker portion having a thicker portion area in the range of 10% to 40% of the plectrum area.

10. The plectrum of claim 1 wherein the thicker portion comprises a central layer and additional layers attached to the central layer.

11. The plectrum of claim 1 wherein the plectrum is made of a single layer encompassing the gripping portion and the thicker portion.

12. The plectrum of claim 1 comprising at least one polymer material.

13. The plectrum of claim 1 comprising at least one plastic material.

14. The plectrum of claim 1 comprising at least one natural material.

15. A plectrum for striking a stringed instrument, the plectrum comprising:

(a) gripping means for facilitating gripping the plectrum, the gripping means having a uniform first thickness and a first flex;

(b) plucking means for striking a stringed instrument, the plucking means being narrower than the gripping means, having a second thickness greater than the uniform first thickness and a second flex that is less than the first flex; and (c) an arcuate transition means that is concave relative to the gripping means for transitioning between the gripping means and the plucking means.

16. The plectrum of claim 15 wherein the plucking means comprises tip means for contacting a string of the stringed instrument.

* * * * *